United States Patent [19]

Cone

[11] Patent Number: 4,822,030

[45] Date of Patent: Apr. 18, 1989

[54] JUVENILE WALKER

[75] Inventor: Richard E. Cone, Dayton, Ohio

[73] Assignee: R/D/ & D, Inc., Dayton, Ohio

[21] Appl. No.: 138,720

[22] Filed: Dec. 28, 1987

[51] Int. Cl.[4] ..... A63B 25/00; B62B 9/12; A47D 13/04

[52] U.S. Cl. ..... 272/70.3; 280/43.24; 280/87.051; 297/5

[58] Field of Search ..... 272/70.3, 70.4, 93; 280/87.01 W, 87.05, 43.23, 43.24, 43.14; 297/5, 6, 7; 135/67

[56] References Cited

U.S. PATENT DOCUMENTS

| | | | |
|---|---|---|---|
| 146,997 | 2/1874 | Eddy . | |
| 174,793 | 3/1876 | Erikson . | |
| 188,120 | 3/1877 | French . | |
| 230,048 | 7/1880 | Patten . | |
| 248,753 | 10/1981 | Huston . | |
| 394,716 | 12/1888 | Odell . | |
| 466,573 | 1/1882 | Platto . | |
| 559,424 | 5/1896 | Weiland . | |
| 935,289 | 9/1909 | Wood . | |
| 1,014,440 | 1/1912 | Benskin . | |
| 1,250,045 | 12/1917 | Steinbach . | |
| 2,513,440 | 7/1950 | Alderson . | |
| 2,754,120 | 7/1956 | Green . | |
| 2,798,652 | 7/1957 | Easton . | |
| 2,803,510 | 8/1957 | Carbary . | |
| 3,179,438 | 4/1965 | Field | 280/43.14 |
| 4,576,392 | 3/1986 | Quinlan . | |
| 4,615,523 | 10/1986 | Chen | 280/87.02 W |

FOREIGN PATENT DOCUMENTS

| | | |
|---|---|---|
| 0915866 | 10/1945 | France . |
| 0570797 | 7/1945 | United Kingdom . |

*Primary Examiner*—Richard J. Apley
*Assistant Examiner*—S. R. Crow

[57] ABSTRACT

This invention is concerned with a portable juvenile walker which may also function as a rocker. The walker has a seat portion. A tray may be associated with the seat portion. The seat portion is connected to a base frame which is substantially rectangular. The base frame is further hollow and as a cross section which is generally U shaped. A plurality of U shaped support bars are pivotally connected to the base frame and are of such a size that they can nest inside the bottom side of the base frame. Each of the U shaped support bars incorporates a plurality of wheels or casters. The terminal ends of the U shaped support bars are pivotally connected to the base frame. Each of the U shaped support bars is associated with a latch means whereby, the U shaped support bars can be locked into a plurality of positions. The bottom edges of the base frame may be planar or arcuate such that the composite device can function as a seat, or a rocker when the base frame engages the floor.

20 Claims, 2 Drawing Sheets

JUVENILE WALKER

BACKGROUND OF THE INVENTION

1. Field of the Invention

The present invention relates to juvenile walkers of the type used by children, and more particularly, to a juvenile walker which safely, conveniently and comfortably supports a child during the period when it is learning to walk.

2. Description of the Prior Art

Devices which assist a child in learning how to walk have been common in the prior art for at least one hundred years. These devices are generally comprised of a wheeled base and a seat section for supporting the lower torso of the child. The seat section is of such a height that the occupant child's feet can securely engage the ground in such a manner as to propel the walker across a planar surface. Normally a young child, when first using a walker, can only push the walker backwards and at times becomes frustrated until they learn to propel the unit in a forward direction.

Because young children at the age when they are learning to walk are not responsible, it is desirable to have a convenient means whereby the walker can be immobilized in such a manner that it can no longer be easily propelled by the occupant. In the prior art, this end has been accomplished by retracting the wheels of the walker in various ways.

Further, when the wheels are retracted in some instances, parents want a means of amusing the child while the walker is immobilized. The most common means for amusing a yound child is to provide a means whereby it can be rocked. In order to accomplish this end the bottom edge of the support frame may be curved in such a manner that it functions as a rocking surface. Again, walkers which have curved lower surfaces which can function as a rocker when the wheels are retracted are known in the prior art.

Examples of pertinent patents which disclose the prior art as described above are:

French Pat. No. 915,866 shows a walker which can be converted into a rocker when the wheels are individually folded up, the wheel supports becoming part of the rocker surface.

U.S. Pat. No. 559,424 is concerned with a walker, wherein the middle of the rocking surface is pivotly connected. When the rocking surface is drawn upward wheels 5 engage the ground.

U.S. Pat. No. 174,793 discloses a combination walker rocker where rocking surface D folds upward to expose wheels E.

U.S. Pat. No. 4,576,392 is an example of a prior art walker which is not convertible. The structure of this patent is typical of current prior art walkers.

British Pat. No. 570,797, U.S. Pat. No. 230,048, U.S. Pat. No. 2,754,120 U.S. Pat. No. 188,120, U.S. Pat. No. 394,716 and U.S. Pat. No. 1,250,045 are representative of the prior art, wherein, juvenile devices other than walkers are converted from one mode to another mode by the retraction of a set of wheels. Further these prior art structures are heavy and hence they are only suitable for use by children who are of such an age that they can support themselves.

From the above discussed patents, it is evident that a need exist for a comfortable light weight walker which is suitable for use by younger children and which can be readily converted from a walker to either a chair or rocker with the utmost of ease. Further, there is a need for a walker wherein when the device is in either the seat or chair mode wheels are retracted in such a manner that they are safely stored in the walker base. Likewise, there is a need for a convertible walker that can be economically manufactured.

As illustrated by the prior art patents as discussed above and commercial device, efforts have been continuously made, for over one hundred years to more safely, conveniently and comfortably secure a child in a convertible walker. None of these prior efforts, however, suggest the present combination of light weight components arranged and configured for the efficient solution of this problem as disclosed and claimed herein. Prior devices do not provided the benefits that the proposed invention achieves through unobvious combination of components and with a minimum number of functioning parts.

Therefore it is an object of the present invention to provide a juvenile walker which includes an improved retraction means.

It is a further object of the invention to provide a kick space between the rocking element and the child in the unit so that occupant toes can not be pinched when the structure is rocking.

It is also an object of this invention to provide an aesthetic pleasing walker wherein the wheels or casters are stored in the base when not in use. Further, it is an object of this invention to provide a walker which has no exposed hinge members which can function as pinch points during usage.

It is still another object of this invention to create a walker which can be readily immobilized with the child in the unit such that the safety of the child is assured.

Lastly, it is an object of this invention to provide an improved juvenile walker that is comfortable for the child in usage, in order to assure the contentment of the child, especially younger children who are unable to effectively use a conventional walker in order to amuse themselves.

These objects and advantages should be construed as merely illustrative of some of the more prominent features and applications of the present invention. Many other beneficial results can be obtained by applying the disclosed invention in a different manner or by modifying the invention within the scope of the disclosure. Accordingly, other objects and advantages, as well as a fuller understanding of the invention, may be had by referring to the summary and detailed description of the preferred embodiment of the invention in addition to the scope of the invention as defined by the claims taken in conjunction with the accompanying drawings.

SUMMARY OF THE INVENTION

The present invention is defined by the appended claims with the specific preferred embodiment shown in the attached drawings. For the purposes of summarizing the invention, the invention may be described as a juvenile walker having a hollow base frame which could be square, round or rectangular. The wheels are attached to a pair of shaped support bars, in this design. They are "U" shaped. These support bars have the same general shape as the base frame and are adapted to be retracted into the base frame. Each "U" support bar incorporates two or more wheels. The ends of the U shaped support bars are pivotly attached to the underside of the base frame, near its center.

At the center of each U shaped support bar is further provided with a spring biased detent which engages the outer edge of base frame in locking grooves. By locking this spring biased detents in various locking grooves the U shaped support bars can be locked into either an up or down position. When these U shaped support bars are in a down position, the wheels engage the floor and hence the composite walker can be rolled by a juvenile user. When the U shaped support bars are retracted up into the base frame the wheels no longer engage the floor but instead the base frame engages the floor and hence the walker is immobilized.

The lower edges of at least two outboard sides of the base frame may be arcuate. These arcuate edges function as a rocking surface. According, in the embodiment, when the U shaped support bars are retracted up into the base, the composite structure becomes a rocking seat. The inboard vertical surfaces of the base frame are shorter than the outboard vertical surfaces in order to prevent a child from pinching body parts between the base frame and the floor when the structure is used as a rocker.

As is discussed above in accordance with one preferred embodiment, the lower outboard edges of the base frame are arcuate in order to facilitate a rocking motion. In another mode, the lower edge of the base frame are planar to facilitate conversion to an immobile chair or seat.

Associated with the above described base is an appropriate seat means which is operatively connected to the base frame. This seat means may be attached to a support structure which can be lowered or raised at the option of the parent. The adjustable support structure may be such that the seat means can be locked into any one of a plurality of positions in order to accommodate the leg length of the juvenile user.

The foregoing has outlined rather broadly the more pertinent and important features of the present invention in order that the detailed description of the invention that follows may be better understood whereby the present contribution to the art may be more fully appreciated. Additional features of the invention will be described hereinafter which form the subject of the claims of the present invention. It should be appreciated by those skilled in the art that the conception and the specific embodiment disclosed herein may be readily utilized as a basis for modifying or designing other apparatus for carrying out the same purposes of the present invention. It should also be realized by those skilled in the art that such equivalent apparatus does not depart from the spirit and scope of the invention as set forth in the appended claims.

DESCRIPTION OF THE DRAWINGS

For a more complete understanding of the nature, objects and advantages of the present invention, reference should be had to the following detailed description taken in conjunction with the accompanying drawings in which.

DESCRIPTION OF THE PREFERRED EMBODIMENT

Figure 1:
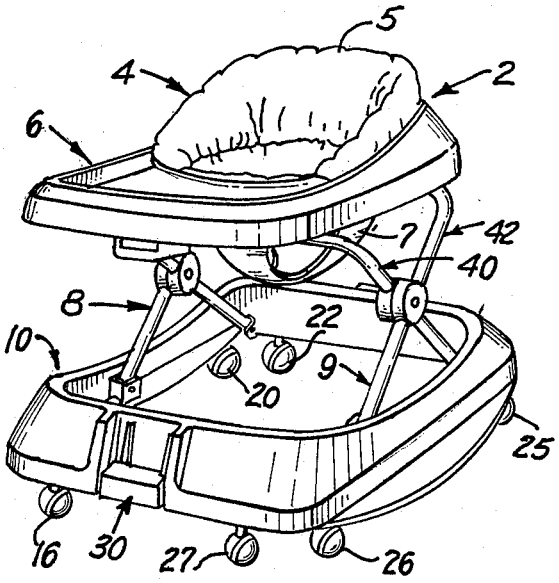
FIG. 1 is a perspective view of a juvenile walker constructed in accordance with the principles of the present invention in a rolling mode.
Figure 2:
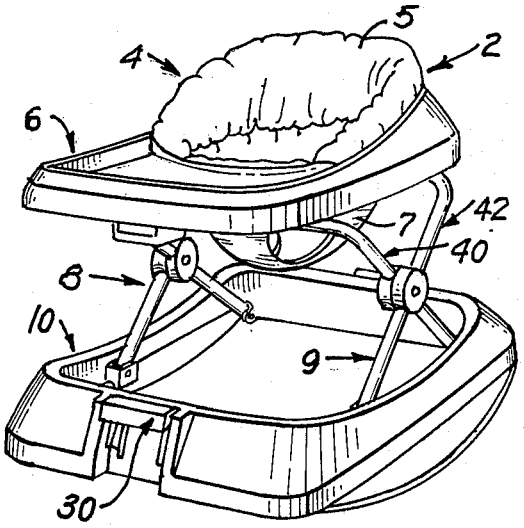
FIG. 2 is a perspective view of a juvenile walker constructed in accordance with this invention in a rocking stance.

Referring to FIGS. 1 and 2 and the basic parts of the juvenile walker of this invention can be seen. Juvenile walker 2 incorporates a plurality of basic parts. Because the device is a walker it has a seat portion 4, This seat portion may be further associated with a tray section 6. Tray section 6 may support seat portion 4.

In the embodiment as illustrated tray section 6 is further associated with support structure 8, which is in turn connected to base frame 10. Attached to base frame 10 are a plurality of corresponding U shaped support bars 12 and 14 which are more clearly seen in FIG. 4. Further connected to each of the U shaped support bars 12 and 14 are a plurality of wheels or casters 16, 18, 20, 22, 24, 25, 26 and 27. Further connected to base frame 10 are a pair of latches 28 and 30. The positioning of latches 28 and 30 can be observed in FIG. 4.

FIG. 1, 2, 3, 4 and 8 show the juvenile walker of this invention in its various operating modes. In FIG. 1 the device of this invention is in a mode whereby it can be used as a walker. As can be seen wheels or casters 16, 25, 26, and 27 extend below base frame 10. As a result of this extension these wheels or casters can engage the ground and hence a toddler, not shown can readily propel juvenile walker 2 and himself across a planar surface. A child is greatly amused by this ability when he is in the awkward stage of wanting to walk but not being able to support himself on two legs.

In FIG. 2 the U shaped support bars have been withdrawn into base frame 10 and hence wheels or casters 16, 18, 20, 22, 24, 25, 26 and 27 are no longer exposed. As a result of this lack of exposure juvenile walker 2 becomes essentially immobile and therefore a toddler can no longer easily propel himself across a planar surface. This immobility may be desired by the guardian of the toddler for safety reasons. From a further examination of the bottom edges of base frame 10 it can be seen that these outside edges are arcuate. As a result of this arcuate nature of the bottom edges of base frame 10 a todder can rock himself and the composite juvenile walker. A rocking motion can be further provided to the composite structure by a person other than the toddler such as the guardian. In the preferred embodiment the arc of the outside edges of base frame 10 is about a 30 inch radius.

Figure 8:
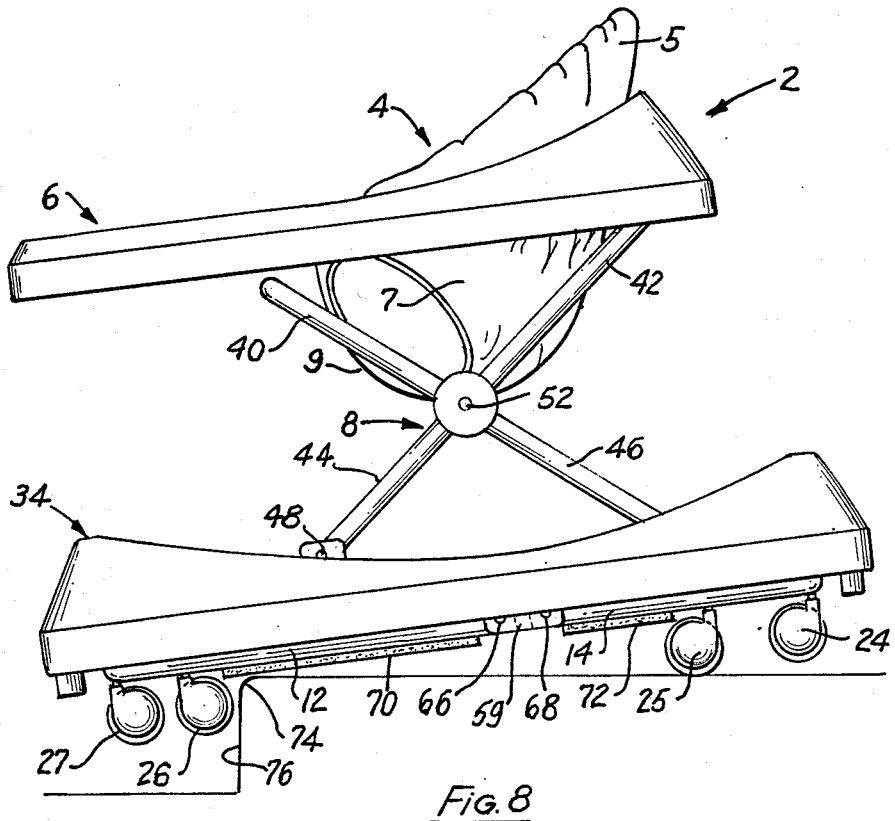
FIG. 8 is a side view of a non rocking version of the walker of this invention. The same numerals refer to the same parts throughout the Figures as described above.

As is illustrated in FIG. 8 in still another embodiment the juvenile walker of this invention can utilize a base frame 34 which has planar lower edges. In this embodiment the juvenile walker can function as either a walker bouncer or a chair. In the chair mode wheels or casters 16, 18, 20, 22, 24, 25, 26 and 27 are drawn up into base frame 34. As a result of this withdrawal the bottom edges of base frame 34 firmly engages the support surfaces. In this stance the toddler is literally grounded as a result of a decision which was made by his guardian.

The ability to ground a toddler is advantageous for safety reasons.

Figure 3:
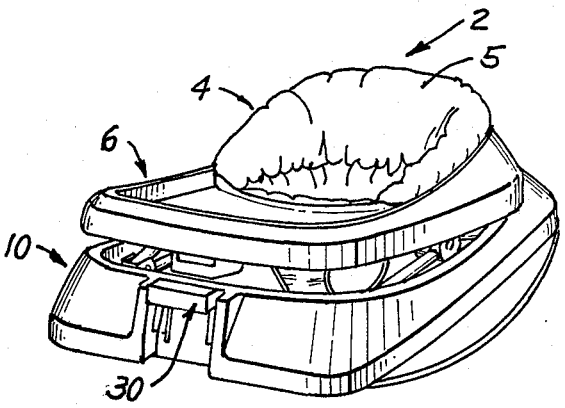
FIG. 3 is a perspective view of a juvenile walker in accordance with this invention wherein the seat support is collapsed.

In FIG. 3 the composite structure is shown in a collapsed or folded up mode. This position is useful for storage when the juvenile walker is not in use. In order to achieve the collapsed position, as is illustrated in FIG. 3 it is evident that support structure 8 must be collapsible. While this is the preferred embodiment it is understood by one skilled in the art that the juvenile walker of this invention can utilize rigid seat supports in order to produce non collapsible walkers.

Figure 4:
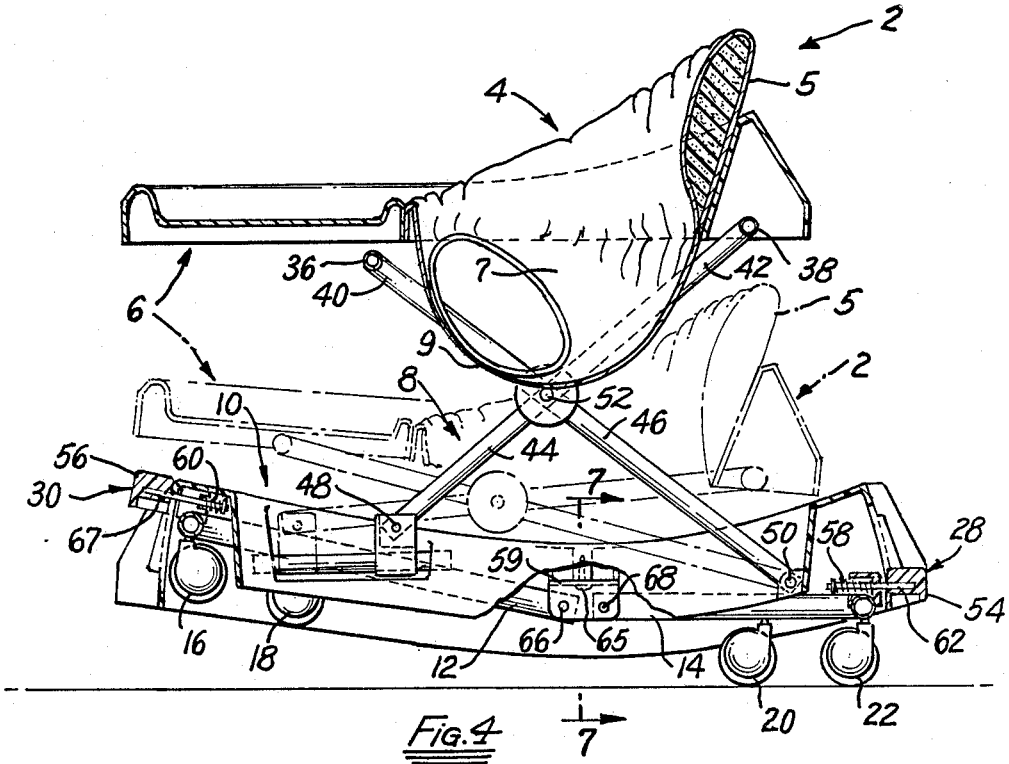
FIG. 4 is a cut away side view showing a juvenile walker in accordance with this invention.

With reference to FIG. 4 it can be seen that legs 40 and 42 of support structure 8 are pivotly connected to tray section 6 at points 36 and 38. In turn arms 44 and 46 of support structure 8 are pivotly connected a base frame 10 at points 48 and 50. As a result of the pivotal connection of the arms of support structure 8 at point 52 the composite structure can fold down on itself in a manner as is shown in dotted lines in FIG. 4. It is understood by one skilled in the art that the collapsible nature of only one half of support 8 was described herein above. The composite structure support structure as is illustrated in FIG. 1,2 and 4 utilizes two halves 8 and 9.

Seat portion 4 as is shown in FIG. 1, 2, 3 and 4 has a back support 5 and a torso support 7. As illustrated, back support 5 is a padded member. Torso support 7 is a web of a flexible material such as a nylon or cotton fabric which is associated with back support 5. In the preferred embodiment the padding for back support 5 is integral with torso support 7. When the subject juvenile walker is collapsed as is shown in FIG. 3 torso support 7 collapses up against back support 5. In the preferred embodiment of this invention the bottom edge 11 of torso support 7 is from about 9 to 11 inches above the floor.

Figure 5:
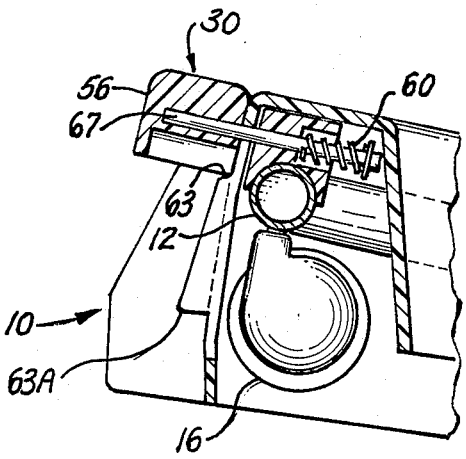
FIG. 5 is a cut away side view showing details of the latching mechanism as used in this invention.

As can be seen by referring to FIG. 4 base frame 10 incorporates two latches 28 and 30. From FIG. 5 it can be seen that latch 30 incorporate a paw 56 which is biased inwardly by spring 60. When Paw 56 engages detent 63 which is integral with base frame 10, the wheels are locked in the up position. At the bottom of the ribbing forming detent 63 is another detent, 63A. When Paw 56 is engaged into detent 63A, the support bar and wheels are locked in the down position and the unit is in the rolling mode. Latch 30 rides up and down in a pair of vertical slots 31 and 33 as are shown in FIG. 2. Latch 30 has two central shafts which ride in slots 31 and 33. Only one shaft 67 is shown in FIG. 5. If the U shaped support bar is locked up, the wheels or casters do not engage the supporting surface and hence the subject juvenile walker is immobile. Conversely if the U shaped support bar is locked down the wheels or casters may engage the supporting surface and hence the juvenile walker is mobile.

U shaped support bars 12 and 14 are illustrated to incorporate eight casters or wheels etc. It is understood that any convenient number of casters or wheels can be used.

Figure 6:
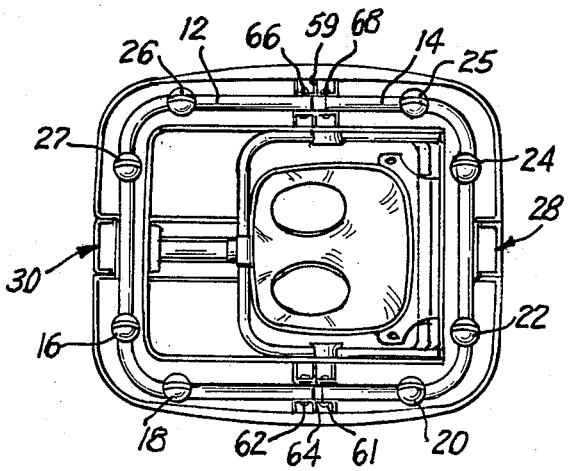
FIG. 6 is a bottom view showing the juvenile walker of this invention.

In the bottom view of FIG. 6 it can be better seen how U shaped support bars 12 and 14 nest into base frame 10. Further, it can be seen that support bar 12 comprises a par of opposing leg sections 13, 15 and a byte section 17.

Figure 7:
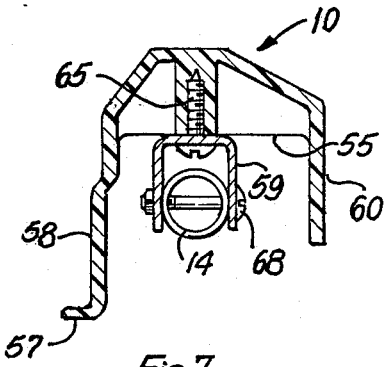
FIG. 7 is a cross section through line 7-7 of FIG. 4.

From FIG. 7 the U shaped cross section of base frame 10 can be seen. The U shaped nature of base frame 10 comprises a pair of downwardly depending legs 58 and 60 and a byte area 62. U shaped support bar 12 nests in base frame 10 and at its outermost edge contacts byte area 62. In this stance wheels or casters 24 etc. are tucked into base frame 10. Inner leg 60 is shorter than outer leg 58. Bottom edge 59 of outer leg 58 engages the planar support surface. In contrast inner leg 60 does not engage the support surface and hence it does not provide a pinch point.

From a further examination of FIG. 4 the cooperation an attachment of U shaped support bars 12 and 14 with and to base frame 10 can be seen. The showing of FIG. 4 is for illustration only in that U shaped support bar 12 is in a retracted stance while U shaped support bar 14 is in a ground engaging stance. For practical utilization both U shaped support bars should be in the same stance. This FIGURE clearly shows how U shaped support bar 12 nest up and into base frame 10. Further it can be lowered to a mode wherein wheels or casters 16 and 19 engage the support surface. U shaped support bars 12 and 14 are attached to base frame 10 via U shaped saddles 59 and 61 and pivot pins 62, 64, 66 and 68 which pass through U shaped saddles 59 and 61. Saddles 59 and 61 are illustrated as separate metallic elements which are secured to base frame 10 with screw 65. In the preferred embodiment of this invention base frame 10 and tray section 6 are injection molded from a thermoplastic material such as high density polyethylene. It is understood by one skilled in the art that in the injection molding process saddles 59 and 61 may be formed as an integral part of the base frame. It is understood that base frame 10 can be formed by other techniques.

U shaped support bars 12 and 14 and support structure 8 are preferably from a high strength steel or aluminum tubing. Likewise support frames 12 and 14 may be molded from a high strength polymeric material.

A further safety feature is illustrated in FIG. 8. In the structure as illustrated U shaped support bars 12 and 14 further incorporate high friction pads 70 and 72. These high friction pads are adapted to engage the leading edge 74 of step 76 in the event a child inadvertently pushes walker 2 off of the top step 76 of a stairs. In this event pad 70 engages leading edge 74 thereby preventing walker 2 from proceeding further thereby preventing serious injury to the occupant child. While separate high friction pads 70 and 72 are illustrated it is understood that U shaped support bars 12 and 14 may be totally or partially coated with a high friction material which may be an elastomer. This elastomer coating may be used to impart a decorative coating to U shaped support bars 12 and 14.

The present disclosure includes that information contained in the appended claims as well as that in the foregoing distribution. Although the invention has been described in its preferred form or embodiment with a certain degree of particularity, it is understood that the present disclosure of the preferred form has been made only by way of example and that numerous changes in the details of construction, fabrication and use including the combination and arrangement of parts, may be restored to without departing from the spirit and scope of the invention.

Now that the invention has been described, What is claimed is:

1. A juvenile walker comprising a seat portion, a support structure operatively connected to said seat portion;

said support structure being operatively connected to a base frame which is substantially rectangular and has a hollow U shaped cross section, the arms of the U shaped cross section being downwardly depending;

two U shaped support bars oppositely directed and each having its terminal ends centrally directed and pivotally. connected to the underside of said base frame, said U shaped support bars being of such a size that they are adapted to nest inside of said base frame, a plurality of casters or wheels being attached to each of said U shaped support bars.

and latches associated with both the U shaped support bars and base frame for biasing and retaining said U shaped support bars for engaging or disengaging the castors or wheels with a support surface.

2. The juvenile walker of claim 1 wherein the bottom edges of the base frame are planar and wherein portions of said U shaped support bars are coated with a high friction material.

3. The juvenile walker of claim 1 wherein the bottom outside edges of the base frame are arcuate.

4. The juvenile walker of claim 1 wherein the bytes of the U shaped support bars are substantially parallel with the leading edge of the base frame.

5. The juvenile walker of claim 1 wherein the bytes of the U shaped support bars are substantially at right angles to the leading edges of the base frame.

6. The juvenile walker of claim 1 wherein the base frame incorporates a plurality of U shaped saddles to which are pivotally attached to the terminal ends of the U shaped support bars.

7. The juvenile walker of claim 1 wherein the base frame incorporates two centrally located U shaped saddles which are integral or attached to said base frame, the terminal ends of the U shaped support bars being pivotally attached to said saddles.

8. The juvenile walker of claim 1 wherein the seat portion is further associated with a tray section.

9. The juvenile walker of claim 1 wherein the support structure is rigid.

10. The juvenile walker of claim 1 wherein the support structure is collapsible.

11. The juvenile walker of claim 10 wherein the seat portion is further associated with a tray section,

12. The juvenile walker of claim 1 wherein the bytes of each of said U shaped support bars incorporate two wheels or casters.

13. The juvenile walker of claim 1 wherein the seat portion is a preformed polymeric shell.

14. The juvenile walker of claim 1 wherein the seat portion is a flexible web.

15. The juvenile walker of claim 11 wherein the support structure comprises a pair of X frames the upper ends of which are pivotally connected to said tray and the lower ends of which are pivotally connected to said base frame.

16. The juvenile walker of either claims 4 or 7 wherein the bottom edges of the base frame are planar.

17. The juvenile walker of either claims 11 or 16 wherein the bottom edges of the base frame are planar.

18. Thejuvenile walker of either claims 4 or 7 wherein the bottom edges of the base frame, which are at right angles to the bytes of the U shaped support bars, are arcuate.

19. The juvenile walker of either claim 11 or 16 wherein the bottom edges of the base frame, which are at right angles to the bytes of the U shaped support bars, are arcuate.

20. The juvenile walker of claim 19 wherein the arc of the outside bottom edges of the base frame is approximately a 30 inch radius.

* * * * *